United States Patent [19]

Wilson

[11] Patent Number: 4,799,446

[45] Date of Patent: Jan. 24, 1989

[54] KAYAK CONSTRUCTION

[76] Inventor: Thomas G. Wilson, Rte. #1, Box 1391B, McKee, Ky. 40447

[21] Appl. No.: 465,438

[22] Filed: Feb. 10, 1983

[51] Int. Cl.[4] ..... B63B 35/71

[52] U.S. Cl. ..... 114/347

[58] Field of Search ..... 114/347, 354–358

[56] References Cited

U.S. PATENT DOCUMENTS 4,031,580 6/1977 Neumann et al. ..... 114/347

FOREIGN PATENT DOCUMENTS 2030078 4/1980 United Kingdom ..... 114/347

*Primary Examiner*—Sherman D. Basinger

*Attorney, Agent, or Firm*—Wood, Herron & Evans

[57] ABSTRACT

An improved kayak includes a frangible cockpit area which cracks or breaks, and is easily torn, when the kayak is subjected to a wrapping situation. Use of high elongation material in the hull and in the bow and stern areas of the deck present a strong resistance to breaking at these areas when the kayak is subjected to normal stresses. Use of relatively lower elongation or more frangible material in the cockpit deck area produces as controlled, predetermined area of preferred breakage during wrapping or similar stress situations without decreasing the kayak's overall resistance to breakage in normal use.

29 Claims, 2 Drawing Sheets

KAYAK CONSTRUCTION

This invention relates to boats and more particularly to kayaks.

White water sports have become increasingly popular in this country and elsewhere. One particular manner of enjoying white water is to use a kayak or decked canoe, of which there are numerous varieties.

Kayaks subjected to white water excursions generally take a great deal of stress abuse, varying in cause from inexperienced users, on the one hand, to highly qualified persons traversing extremely difficult sections of water, on the other hand. The selection and use of a kayak must be made then with particular care, taking into consideration the skill of the user, the class of water in which the kayak will be used, and the overall conditions to which the kayak will be subjected. Of high concern is not only the ability of the kayak to take abuse, but the overall safety provided by the kayak.

In difficult water sections, kayaks are subjected to large stresses which tend to flex or bend the kayak structure. These are encountered, for example, where the kayak is stood on end, as in sliding down a standing wave, or where the kayak hits an obstruction at speed. In anticipation of these forces and stresses, it is generally desirable to produce a structure which will withstand the abuse without breaking.

There are at least two general ways to manufacture a kayak to meet these difficulties. For example, it is known to manufacture kayaks by the "roto-mold" method where synthetic material is placed in a mold and the mold is slowly rotated to fill out mold voids and surfaces with material. Kayaks made in this manner tend to be exceptionally strong and have a stress characteristic referred to as high elongation. That is, the kayak material tends to stretch or bend rather than breaking or tearing. The material simply extends or stretches in the stress area without breaking.

While such kayaks are very strong, and provide significant resistance to abuse before being rendered unfit for use, they have several inherent disadvantages. First, such kayaks are generally relatively heavy, on the order of 45 pounds or over. Secondly, it is expensive to manufacture such kayaks, molds costing on the order of $50,000 each. Thirdly, and much more importantly, is a safety consideration.

Since such kayaks tend to bend and not break, it is possible that they could be bent around a rock, tree or obstruction in the water, trapping the kayaker inside, as a result of water pressure against the kayak deck structure pressing on the kayaker's legs. Such a situation could occur, for example, where a kayak hit an obstruction and was bent, by oncoming water pressure, around the obstruction in a "U-shape", with the kayaker headed upstream. Water pressure on the kayak deck could tend to press the deck against the kayaker's legs, making it impossible for him to extract himself, and resulting in a highly dangerous, potentially fatal situation. Moreover, the inherent strength and resistance to tearing of the roto-molded synthetic material could make it impossible for the kayaker to tear the kayak material in order to extricate his legs.

Another known method of producing kayaks is to manufacture them from very stiff material such as fiber glass or a fiber glass synthetic mesh combination. Fiber glass laminates are lighter in weight and have the stress characteristic of relatively lower elongation, as compared to the roto-molded kayaks. Accordingly, fiber glass made kayaks, when subjected to stresses such as those mentioned above, tend to tear or break, rather than to stretch and bend.

This characteristic in kayaks, however, produces the disadvantage that such kayaks might break under conditions where breaks are not desired. For example, should the kayak be stood on end, as in going down a standing wave, or should it ram an obstruction, such kayaks tend to break sooner than roto-molded kayaks, which may only slightly stretch or bend, and return to shape. Even small breaks or cracks can disable a kayak as they leak, become hard to maneuver, fill with water, and may even sink, at least to the extent of buoyancy provided by extra flotation.

Even when such known prior kayaks had hull and deck areas made from a laminate of synthetic mesh (itself having a relatively high elongation characteristic) and fiber glass, the resulting laminated structure is very stiff, due to the fiber glass, and the normally high elongation characteristic of the mesh is overcome, the overall structure rendered brittle by the resulting stiff laminated structure. Such material, though held together by the mesh, still is prone to break, rather than stretch.

In such a prior structure, a kayak hull and deck was made up from a layer of synthetic mesh material surrounded by layers of fiber glass. The deck area surrounding the cockpit was made from fiber glass alone, however, since the fiber glass of the deck and hull so stiffened the synthetic mesh, the entire structural material was resultingly stiff and had a very low elongation factor. Accordingly, it was prone to break or crack rather than stretch or bend. The mesh material did tend to retain broken parts together; however, it provided essentially no higher elongation function and the hull and deck were still prone to breakage when subjected to stress.

It is realized that the stiff, break prone fiber glass constructed kayaks did provide a measure of safety, since a kayaker could more readily escape from a broken kayak that was caught and stretched out of shape. Nevertheless, such stiffer kayaks are also prone to undesirable breakage when subjected to ordinary operating stresses, and thus did not provide as long a useful life as kayaks consructed from other materials such as those having higher elongation factors.

Accordingly, it has been one objective of this invention to provide an improved kayak.

A further objective of the invention has been to provide an improved kayak having increased resistance to breakage, but with improved safety characteristics wherein a kayaker is less likely to be trapped in the event of the kayak wrapping about an obstruction.

A further objective of the invention has been to provide an improved boat.

To these ends, a preferred embodiment of the invention includes a kayak having both the bow and stern areas of the hull and the deck made from a material having high elongation characteristics, more prone to bend than break when subjected to stress, and a frangible cockpit made from much stiffer construction materials having a lower elongation factor, which tend to break and not to stretch or bend. Moreover, the hull beneath the cockpit area is built up with additional, high elongation factor material, to produce a band of relatively stiffer material than the remainder of the hull. This cooperates with the stiff deck and hull areas near the cockpit to produce a predetermined and controlled breakage cockpit area, and to provide increased user protection. This construction produces a kayak which has strong resistance to breakage, along hull and deck, when subjected to normal operating stresses in even difficult water, yet which permits breaking of the cockpit area when the kayak is subjected to wrapping forces tending to bend the kayak and otherwise trapping a kayaker inside.

Such a preferred embodiment includes a hull and deck made from a combination of high elongation, synthetic mesh material treated with resin, and a cockpit deck area made from relatively stiff, more frangible material such as fiber glass, having low elongation characteristics and being prone to break before stretching. In such a kayak, the hull and deck, apart from the cockpit, are strong and provide a stress resistance similar to or greater than that of roto-mold or all high elongation material kayaks. Nevertheless, the cockpit area is disposed within a controlled breakage area such that the desirable high elongation characteristics of the bow and stern areas do not work adversely to produce potential safety hazards at the cockpit area. Rather, the deck area around and in front of the open cockpit is more prone to crack and break, permitting easier user egress in an emergency situation.

Moreover, such a kayak can be made at a weight of about 37 to 40 pounds, at least about 5 pounds less than a roto-mold unit, yet producing the same or greater strength and wear characteristics of such a kayak and with an increase of safety.

In use, a kayak according to the preferred embodiment of the invention can be used in difficult water sections, producing great resistance to breakage when subjected to general operating stresses, such as when standing on end. At the same time, should the kayak be accidentally wrapped around an obstruction, the water pressure will tend to bend the hull and decks in a "U-shape." Nevertheless, the stiff, more brittle area around the cockpit, which is not subjected to breaking stress in other situations, will not fold or bend, but instead will break. This permits the kayaker to readily move the broken deck portion to extricate himself handily. If mesh or other material having a high elongation factor was used in the deck area adjacent the cockpit, water pressure may tend to only bend or stretch such material, pressing it against a kayaker's legs and trapping him in the kayak. Lack of any such material in the cockpit permits manual tearing of the material, once a break is started, in order to provide for further pressure relief and a larger outlet to escape from the wrapped kayak.

In short, kayaks of many varied constructions can be accidentally wrapped about an obstruction. A kayak, deck canoe, or other similar boat structure according to the invention, however, includes a predetermined, controlled breakage cockpit area more likely to break than merely stretch or bend, thereby reducing the possibility of capturing the kayaker, deck canoeist, or the like in the boat. At the same time, the controlled breakage cockpit does not effect the other stress and wear resistance characteristics of the kayak which are produced by construction materials of high elongation characteristics.

These and other objectives and advantages will become readily apparent from the following detailed description of a preferred embodiment and from the drawings in which:

FIG. 7 is a diagrammatic view of a kayak bending or wrapping about an obstruction, and showing the controlled breakage of the cockpit area according to the invention.

While the preferred embodiment of the invention is directed to kayaks, the invention can be utilized in boats of similar structures, such as deck canoes, for example.

Figure 1:
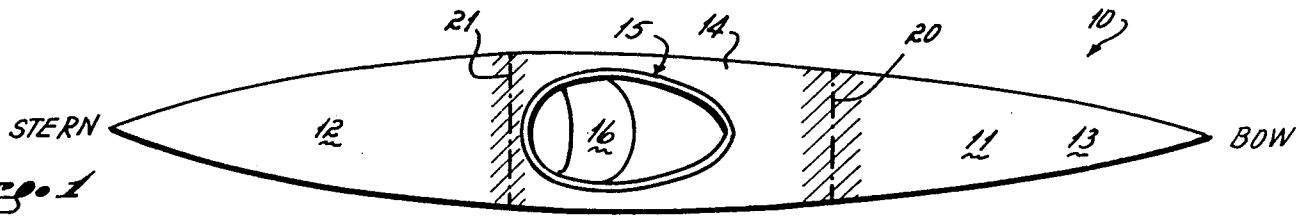
FIG. 1 is a top view of a kayak according to the invention.

A kayak 10 according to the preferred embodiment of the invention as shown in FIG. 1. The kayak 10 includes a deck 11 (FIG. 2) which comprises a stern portion 12, a bow portion 13 and a cockpit area 14. Cockpit area includes a cockpit deck area 14, as shown, generally surrounding cockpit opening 15. Within the cockpit opening 15 and the kayak shell is a seat 16. In use, the kayaker sits on the seat 16, with his legs extending forwardly under the cockpit deck area 14. In a decked canoe, of course, a canoeist would be kneeling.

Figure 2:
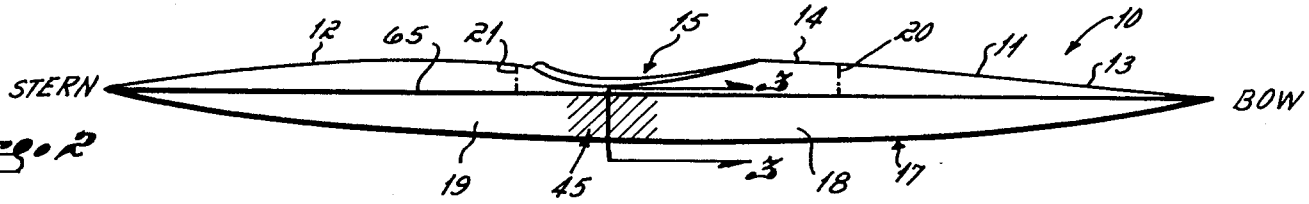
FIG. 2 is an elevational view of the kayak of FIG. 1.

As shown in FIG. 2, the kayak also includes a hull 17 having a bow portion 18 and a stern portion 19. As shown in the drawings, deck 11 is joined to the hull 17 along a seam line 65 by any suitable joining or bonding means, such as resin or adhesive.

As further shown in the drawings, the cockpit deck area 14 is generally defined in the deck 11 as between or just beyond the phantom lines 20 and 21 so that the cockpit area extends from just behind the cockpit opening 15 forwardly of the cockpit opening toward the bow. More particularly, the forward portion of the cockpit deck area extends a distance from the forward end of the cockpit opening 15, which distance is equal to about $\frac{1}{4}$ to $\frac{1}{3}$ the distance between the forward end of the cockpit opening 15 and the bow. In a decked canoe according to the invention, the cockpit deck area extends over about 36 inches and is centralized between the bow and the stern.

If the various components of the kayak were made from similar materials, without modification, such a construction would only produce the disadvantages hereinbefore mentioned. The kayak, then, according to the invention and as shown in the drawings, includes a frangible cockpit which can be broken as a result of the application of forces to the kayak which would otherwise tend to bend, stretch or fold the kayak materials around an obstruction in a stream.

Considering the particular construction of the kayak 10, as shown in FIGS. 1–4, it will be appreciated that the major hull and deck portions of the kayak according to the preferred embodiment of the invention is preferably manufactured from materials which exhibit a very high elongation factor. The cockpit deck area 14, on the other hand, is made from materials which have a very low elongation factor. The cockpit deck area materials are thus more frangible and tend to break before significantly stretching.

Accordingly, by defining the controlled breakage cockpit generally as the cockpit area 14, it will be appreciated that the kayak 10 can be bent in a U-shape around an obstruction R (FIG. 7) such as while the hull and bow and stern portions of the deck are stretched and bent, the cockpit area 14 tends not to stretch but rather to break, thereby permitting the kayaker to pull or tear the cockpit deck structure and thus escape from being trapped therein.

Accordingly, the hull 17 of the kayak is preferably manufactured by laying a plurality of layers of a synthetic woven mesh-like material in a mold. These layers are treated with resin and the components cured so that the entire composite material is hardened to form a multi-layer laminate structure having a relatively high elongation factor, preferably on the order of 10% or greater stretch of original length prior to breaking. Structures having an elongation factor of about 13% are preferred.

Of course, the contrast between the high elongation factor of the hull and deck as opposed to the lower elongation factor (and increased frangibility) of the frangible cockpit area is of perhaps more importance than the actual elongation factors of the specific materials. It is this difference which is believed to produce a strong kayak for absorbing normal stress, and a frangible cockpit, on the other hand, for promoting safety.

Figure 3:
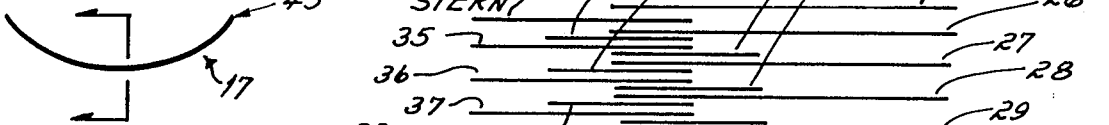
FIG. 3 is a cross sectional view of the kayak of FIG. 2.
Figure 4:
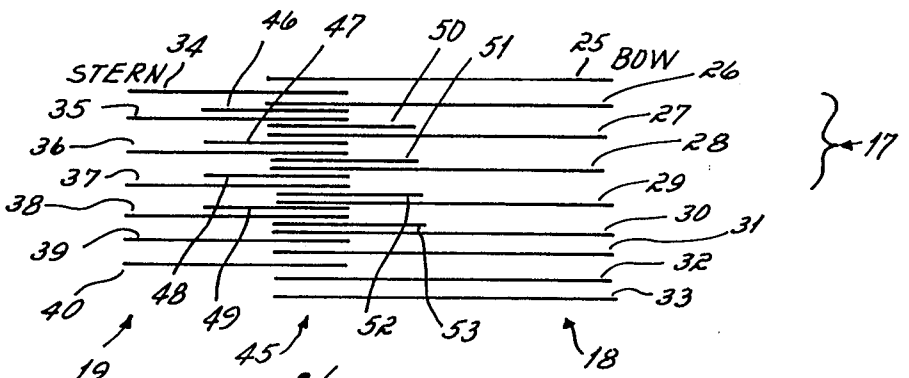
FIG. 4 is a cross sectional, expanded view of FIG. 3 showing the composite layers of the hull.

FIG. 4 depicts a cross section of such laminate structure at the central area of the hull at the cockpit area 14. FIG. 4 is an expanded view of FIG. 3, showing the various relationships of different layers of material which are utilized in the construction of the kayak hull. As viewed in FIG. 4, the stern of the kayak is to the left and the bow is to the right.

From the figures it can be seen that the hull bow is made up of a plurality of layers of material which are preferably a synthetic mesh-like material such as polyester, or other types of mesh-like material which can be treated with a hardening resin compound so as to produce a hard finish laminate structure. Materials such as nylon or other polyolefin materials can be used. For clarity, the layers of the material are referred to by the numerals 25 through 33.

The stern of the kayak hull comprises a plurality of layers of similar mesh material 34 through 40. It will be appreciated that this material has preferably the same relatively high elongation factor as the bow. That is, the material preferably has an elongation factor of over about 10% and preferably approximately 13%, and will thus tend to stretch to approximately 13% of its original length before fatiguing and separating or tearing. This elongation factor is carried over into the composite laminate of the entire hull after the resin with which it has been treated has been cured.

As shown in FIG. 4 and as depicted in FIG. 2, the hull is provided with a stiffened area or belly band 45, constituting a stiffer region in the central portion of the hull directly beneath the cockpit opening 15. The hull is thus stiffer in this area than the other bow and stern portions of the hull. This extra stiffness is produced by the interleaving of additional layers of much shorter synthetic mesh material in this area, as shown in FIG. 4. For example, the layers 46 through 49 are inserted on the stern side of the hull, while the layers 50 through 53 are interleaved on the bow side of the hull, with the inward ends of all the layers 46 through 53 interleaving so as to produce a stiffer belly band as shown in the shaded portion 45 of FIG. 2 and as shown diagrammatically at 45 in FIG. 4. While this area still has a relatively high degree of elongation (as does the entire hull), the area tends to be slightly stiffer, as a result of the additional material used, in order to strengthen the bottom of the hull in the central area and directly beneath the cockpit. In addition, the stiffening of the hull in this area produces a desired function in connection with the controlled breakage cockpit, as will be described.

Moreover, the belly band is generally preferably located in the center of gravity of the kayak about which the kayak is maneuvered. Also, it is preferably located beneath the seal 16 to afford extra structural stiffness and protection.

Figure 5:
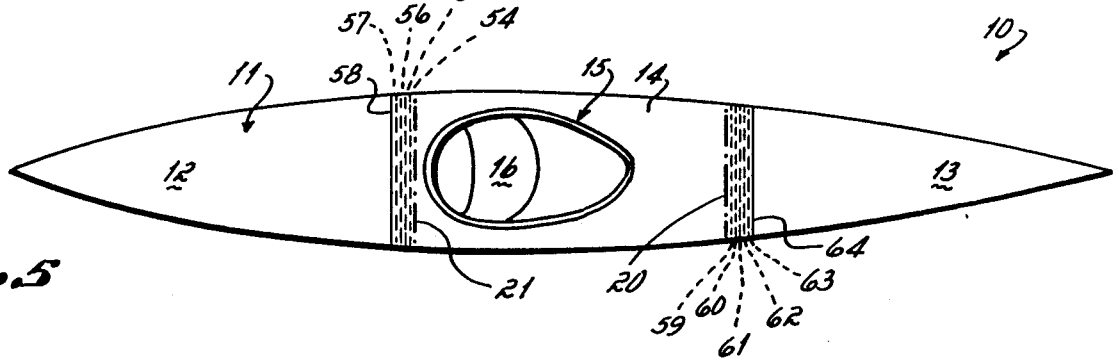
FIG. 5 is a diagrammatic illustration of the composite deck structure of the kayak.
Figure 4:
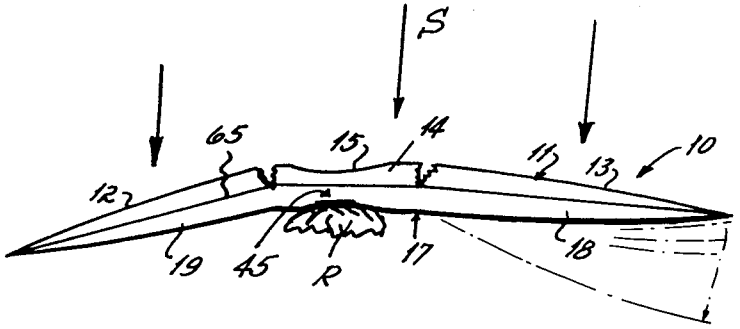

Turning now to FIG. 5, the construction of the deck is shown only in diagrammatic detail. The deck construction, at least in its bow area 13 and its stern area 12, is similar to that construction of the hull. Specifically, a plurality of layers of synthetic material, such as polyester in woven mesh form, are layed into a deck mold and treated with resin in order to form a composite laminate. Preferably, the stern area 12 is made from five layers, while the bow area 13 is made up of six layers of the mesh material. The first or most interior layer of material designated at 54 extends from the stern end toward the cockpit area 14 closest to the cockpit. The next layer of material 55 is run to a distance slightly shorter than that of layer 54 and so on through outside layer 58 to provide an overlapping effect for the attachment of this portion of the deck to the materials of the cockpit deck area 14. In a similar fashion, layers 59 through 64 of the mesh material are laid in the bow portion of the mold such that the innermost underlying layer 59 is slightly longer than the next layer 60 and so on to outside layer 64. This overlapping can be accomplished in any suitable way, with the cockpit deck area materials interleaved with or overlapping alternate portions of adjacent bow and stern deck layers.

The layers of material in both the deck's bow and the stern have a preferable elongation factor of approximately 10% or greater and preferably about 13%. That is, they will preferably stretch to about 13% of their original length before breaking or tearing. As a result, bow and stern areas of the deck component of the kayak also have an elongation factor whereby these materials, and these portions of the deck, tend to stretch rather than to tear or break when subjected to a folding type force as described herein.

The cockpit deck area 14, in which the cockpit opening 15 is defined, is made of entirely diverse materials from an elongation standpoint. Preferably, cockpit deck area 14 is made up of a plurality of layers of mesh material which has a relatively low elongation factor, of about 10% or less and preferably on the order of ½%, such that the material tends to break apart before stretching or elongating.

Of course, as with the hull and other deck portions, it is the contrast of elongation factors, between hull and deck on one hand and the cockpit area on the other, which provides or produces the more frangible cockpit deck area. The contrast can be provided by many materials of diverse elongation factors. Where materials in hull and deck have an elongation factor of about 13% and cockpit area materials have an elongation factor of about ½%, the first elongation factor is about 26 times the second. A contrast of elongation on this order, so produced, has been found useful.

In this regard, cockpit deck area 14 is made up of a plurality of fiber glass on other mesh layers, treated with resin, and which do not include the mesh material of the hull and other deck portions. Material which is utilized for the cockpit deck area is overlapped with respective ends of the various layers making up the stern and bow portions of the deck in order to provide for a smooth surface deck from bow to stern, yet a deck having a center cockpit area which is made up of low elongation materials and being frangible and more prone to controlled breakage, as will be hereinafter described.

After the hull and the deck components of the kayak are manufactured, they are thereafter joined together along the juncture line 65 (FIG. 2) in order to define the kayak 10. Such joining can be accomplished by any suitable bonding technique.

Thereafter, the kayak is finished. That is, any additional finish which is desired might be applied to the hull and deck materials, the seat and fitting are installed, and the kayak is otherwise readied for use as may be desired.

As opposed to prior art kayaks, the kayaks made according to the invention provide many advantges. For example, because the hull and the bow and stern portions of the deck are made from materials which have a relatively high elongation factor, the hull and the forward and rear deck portions are very strong and tend to withstand normal stresses through which a kayak may be put. For example, when the kayak is stood on end as in sliding down a standing wave, large stresses will tend to only first bend or stretch these portions of the kayak. Due to the materials utilized, the bow, for example, tends to only slightly stretch. It does not ordinarily break but returns to its original configuration when the stress is relieved. Accordingly, the hull and the bow and stern deck areas withstand and resist the normal stresses, abrasion and wear to which a kayak is normally subjected.

On the other hand, the cockpit deck area 14 is made of a much stiffer, more frangible and relatively much lower elongation material which will not stretch, but rather tends to break or tear when stresses are applied. Such stresses might be applied, for example, in a situation where it is desirable that the cockpit area break apart as opposed to simply bending or stretching.

Figure 6:
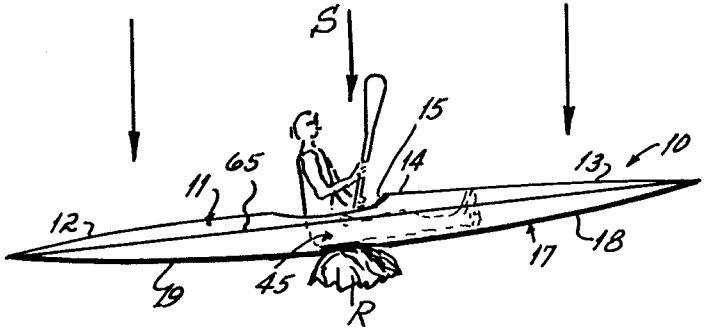
FIG. 6 is a diagrammatic view of a kayak engaging an obstruction in a stream.

Such a situation has already been referred to and is diagrammatically depicted in FIGS. 6 and 7 where the kayak may accidentally engage an obstruction such as a rock, R, in a stream and be wrapped about the rock in a U-shape by the water force, with the kayaker facing upstream as shown in the figures. If the kayak was manufactured such that the entire deck area was made of uniform high elongation material, the water forces exerted on the kayak would tend to press the entire deck area, including that surrounding the cockpit, against the kayaker's legs and would tend to trap him within the cockpit and within the on rushing water.

According to the invention, however, the cockpit deck area 14 does not tend to stretch and press against the kayaker's legs. Rather, the force of the water applied to the entire kayak tends to bend it in a U-shape, thereby stressing the cockpit area 14 which tends to crack or break. Depending on the particular circumstances and force applied, the entire cockpit area may simply break. Otherwise, cracks are at least started as shown and, since the fiber glass material is much easier to tear than the higher elongation material, these breaks or cracks may be continued by the kayaker with the cockpit area 14 being torn and at least providing access or relief through which the kayaker may remove his legs and escape.

Moreover, water can enter through the breaks and tend to counteract water pressure forces pushing inwardly on the deck surface.

Also, it should be noted that the breaks might occur anywhere in the cockpit deck area 14, fore or aft, and underlying the shaded areas surrounding lines 20 and 21 (FIG. 1). Breaks outside lines 20–21 are unlikely and breaks are most likely within the area bordered by lines 20–21. Breakage internally or within the area bounded by lines 20–21 is preferred since it is desirable to be able to manually increase the breakage or tear in the fiber glass material to permit easier egress therefrom.

This controlled breakaway or frangible cockpit area is further facilitated by the belly band 45 described above, which renders the hull much stiffer in a centralized area directly beneath the cockpit. Thus, as shown in FIG. 7, when the kayak engages the obstruction in the belly band area, the hull tends to remain generally stiff at the very center area near the belly band, while the water pressure tends to bend the stern and bow portions of the hull in a U-shape and around the obstruction. This promotes the generation of excessive stress in the upper deck, and particularly in the cockpit deck area 14, tending to crack or break the cockpit area to permit the kayaker to escape. In other words, the stiffer centralized area tends to cause the bow and stern portions of the kayak to pull away or break off from the cockpit area 14 generally between the lines 20 and 21, which diagrammatically define the frangible cockpit area 14 from the remainder of the kayak deck.

Accordingly, this invention contemplates a kayak having a cockpit area which is frangible or can be broken in order to permit a user to escape therefrom in a potentially dangerous situation. Nevertheless, the remainder of the kayak is made so as to withstand the normal stress and abuses to which a kayak is generally subjected.

The resulting kayak, according to the invention, is not too stiff, such as would perhaps subject it to premature failure in the bow or stern area, for example, due to normal stresses, but provides substantial strength in the bow, stern and hull areas. Nevertheless, it is still frangible at the cockpit area and can be torn and broken in order to permit emergency escape. Moreover, such a kayak can be manufactured at a weight of approximately 35 to 40 pounds, although other lighter or heavier weight may result without losing the frangible cockpit construction.

This is believed to be at least approximately 5 pounds less than kayaks currently on the market and manufactured in a roto-mold process, for example, or from other material which has a relatively high elongation factor, wherein the entire cockpit area is of this material.

Accordingly, it will be appreciated that the invention can be used as described with kayaks, or in other similar boat structures such as deck canoes, for example, and in other hull and deck configurations which are used in a way where the advantages provided by the invention are desirable.

Moreover, it will also be appreciated that a frangible cockpit can be provided in kayaks or other such structures, as mentioned above, by other means. For example, a kayak made from high elongation materials could be provided with score lines or perforations defining a frangible cockpit area. The cockpit area could thus be rendered more prone to breakage, by any such means, in accordance with the desired controlled breakage result as described herein.

These and other advantages and modifications will become readily apparent to those of ordinary skill in the art without departing from the scope of this invention, and the applicant intends to be bound only by the claims appended hereto.

I claim:

1. A boat having a hull, deck and a cockpit opening disposed within a cockpit area of said deck and including:

a hull made of material having a first elongation factor;

a deck made of material having a similar elongation factor;

said hull and deck defining between them a space for receiving the legs of a user and extending forwardly therein from a position near said cockpit opening; and a frangible cockpit area defining and comprising a part of said deck, forward of said cockpit opening, said cockpit area made of material having a second elongation factor, less than said first elongation factor, wherein said cockpit area has a tendency to break apart, as opposed to stretching, when said boat is subjected to a wrapping stress tending to bend said hull around an obstruction, thereby opening said frangible cockpit area of said deck when said boat is bent around an obstruction.

2. A boat as in claim 1 having a bow and wherein said cockpit area extends forwardly in said deck from just behind said cockpit to a region intermediate said cockpit and said bow.

3. A boat as in claim 2 wherein said cockpit area extends forwardly toward said bow a distance equal approximately to one-third the distance between said cockpit and said bow.

4. A boat as in claim 1 wherein said hull includes a stiffening band, stiffer than the rest of said hull, said band extending transversely in said hull and beneath said cockpit area.

5. A boat as in claim 1 wherein said hull comprises a plurality of layers of mesh having a first composite elongation factor;

wherein said deck comprises a plurality of layers of mesh having a composite elongation factor similar to said first composite elongation factor, and wherein said cockpit area of said deck comprises a plurality of layers of material having a second composite elongation factor less than said first composite elongation factor.

6. A boat as in claim 5 wherein said mesh and layers of said deck are overlapped with said material layers of said cockpit area.

7. A boat as in claim 5 wherein said first composite elongation factor is in the approximate value of about 26 times the second elongation factor.

8. A boat as in claim 5 wherein said layers of mesh in said hull and deck comprise a synthetic mesh material having an elongation of about 13% of original length prior to breakage, and wherein said layers of material in said cockpit area of said deck comprise fiber glass material having an elongation of about ½% of original length prior to breakage.

9. A boat having a hull, deck and a cockpit disposed within a cockpit area of said deck and including:

a hull made of material having a first elongation factor;

a deck made of material having a similar elongation factor; and a cockpit area defining a part of said deck, said cockpit area made of material having a second elongation factor, less than said first elongation factor, wherein said cockpit area has a tendency to break apart, as opposed to stretching, when said boat is subjected to a wrapping stress tending to bend said hull around an obstruction;

wherein said hull comprises a plurality of layers of mesh having a first composite elongation factor;

wherein said deck comprises a plurality of layers of mesh having a composite elongation factor similar to said first composite elongation factor;

wherein said cockpit area of said deck comprises a plurality of layers of material having a second composite elongation factor less than said first composite elongation factor; and wherein said hull includes an additional plurality of layers of mesh material in a band traversing said hull beneath said cockpit area of said deck.

10. In a kayak structure having a cockpit, a controlled frangible cockpit area forward of said cockpit and wherein said kayak structure includes:

a hull made from material having a first measurable resistance to breakage when subjected to a bending force;

a deck made from a material having a similar measurable resistance to breakage as said first resistance when subjected to a similar bending force; and a frangible cockpit area defining an integral portion of said deck, forwardly of said cockpit and extending substantially across said deck from one side thereof to the other, said cockpit area made from a material having a second measurable resistance to breakage, when subjected to a similar bending force, said second measurable resistance to breakage of said cockpit area being less than said measurable resistance to breakage of said hull and deck materials, such that said frangible cockpit area breaks apart and provides access therethrough when said hull and deck materials are stretched about an obstruction.

11. A kayak structure as in claim 10 wherein said cockpit area material of said deck breaks from other portions of said deck prior to breakage of said hull and deck material, when said kayak is subjected to a bending force tending to wrap said hull and deck into a "U-shape."

12. A kayak having a cockpit opening and comprising:

a kayak deck;

a hull; and a frangible cockpit means defining an integral portion of said deck forwardly of said cockpit opening, for breaking when said kayak is exposed to forces of predetermined strength tending to bend said deck and hull.

13. A kayak as in claim 12 wherein said hull includes a transverse band of increased stiffness extending transversely within said hull beneath said cockpit means.

14. A kayak as in claim 12 wherein said cockpit means includes a cockpit deck comprising approximately one-fourth to approximately one-third the area of said deck.

15. A kayak as in claim 12 having a bow, wherein said cockpit means includes a cockpit opening and a cockpit deck extending from behind said opening forwardly and about one-third the distance between the cockpit opening and said bow.

16. A kayak as in claim 15 wherein said cockpit deck comprises a continuation of said kayak deck.

17. In a boat having a deck, a hull, and a cockpit opening, the improvement comprising:

a frangible cockpit means defining an integral portion of said deck comprising an outer deck surface forwardly of said cockpit opening for breaking forwardly of said cockpit opening when said boat is exposed to forces tending to bend said deck and hull about said frangible cockpit means.

18. A rigid kayak having a hull, deck and a cockpit opening disposed within a cockpit area of said deck, wherein the hull, deck and cockpit area surround the legs of a user of said kayak, said kayak including:

a hull made of material having a first elongation factor;

a deck made of material having a similar elongation factor; and a frangible cockpit area defining a part of said deck forwardly of said cockpit opening, said cockpit area made of material having a second elongation factor, less than said first elongation factor such that said material of said cockpit area breaks apart when subjected to forces which only stretch said hull and deck materials, wherein said cockpit area has a tendency to break apart, as opposed to stretching, when said kayak is subjected to a wrapping stress tending to bend said hull around an obstruction, to provide access through said cockpit area forwardly of said cockpit opening for a user's legs.

19. A kayak as in claim 18 wherein said hull comprises a plurality of layers of mesh having a first composite elongation factor;

wherein said deck comprises a plurality of layers of mesh having a composite elongation factor similar to said first composite elongation factor, and wherein said cockpit area of said deck comprises a plurality of layers of material having a second composite elongation factor less than said first composite elongation factor.

20. A kayak as in claim 19 wherein said layers of mesh in said hull and deck comprise a synthetic mesh material having an elongation of about 13% of original length prior to breakage, and wherein said layers of material in said cockpit area of said deck comprise fiber glass material having an elongation of about ½% of original length prior to breakage.

21. A boat comprising:

a hull;

a deck; and a cockpit opening in said deck, wherein said deck comprises an integral bow portion forwardly of said cockpit opening;

said integral bow portion made of one material in a forward area thereof and a second material in a rearward area thereof;

said forward bow material being more stretchable than said rearward bow material; and said rearward bow material tearing apart in response to forces exerted thereon by said forward bow material to provide access through said deck forwardly of said cockpit opening when said forward bow material is subjected to a predetermined bending force.

22. A boat as in claim 21, wherein said deck further comprises:

an integral stern portion rearwardly of said cockpit opening;

said integral stern portion made of one material in a rearward area thereof and a second material in a forward area thereof;

said rearward material being more stretchable than said forward stern material; and said forward stern material tearing apart in response to forces exerted thereon by said rearward stern material to provide access through said deck rearwardly of said cockpit opening when said rearward stern material is subjected to a predetermined bending force.

23. A boat as in claim 21 wherein said rearward area of said bow portion comprises an outer deck surface.

24. A boat comprising a hull and a deck having bow and stern portions, wherein said deck comprises an integral deck having a central frangible area between said bow and stern portion;

said bow and stern portion comprising a first material and said frangible central area comprising a second material, said first material being more stretchable than said second material such that said central area breaks apart before said bow and stern portions break apart and when subjected to stress applied thereto by said bow and stern portions.

25. A boat as in claim 24, wherein said frangible central area extends across said integral deck from one side thereof to the other.

26. A boat as in claim 24, wherein said central area comprises an outer surface of said deck.

27. A kayak having an integral deck comprising a bow, stern and frangible central portion and a hull having corresponding bow, stern and central portions, the frangible central integral portion of said deck comprising an outer deck surface and having an elongation characteristic which is less than the elongation characteristic of the material comprising the bow and stern portions of said kayak.

28. A kayak as in claim 27, wherein said bow, stern and frangible portions of said deck are integral such that a stress high enough to break said frangible central portion can be transmitted thereto by at least said deck bow portion.

29. In a kayak having a deck, hull and cockpit opening and being of the type subjected to normal bending stresses during use and which can be bent about an obstruction during use so as to capture the legs of a user between said deck and hull, the improvement wherein said deck is integral and has forward and rearward portions of one material having a first resistance to elongation and an integral central frangible area having a second resistance to elongation greater than that of said first material, said frangible central area defining a deck surface forwardly of said cockpit opening and tearing open when subjected to predetermined stresses by bending forward deck portions to provide escape access through said deck.

* * * * *